United States Patent [19]

Maas

[11] 4,128,214

[45] Dec. 5, 1978

[54] DEVICE FOR WINDING A BOBBIN

[76] Inventor: Henricus J. Maas, 395, V. Montgomerylaan, Eindhoven, Netherlands

[21] Appl. No.: 814,422

[22] Filed: Jul. 11, 1977

[30] Foreign Application Priority Data

Jul. 12, 1976 [NL] Netherlands ..... 07710

[51] Int. Cl.[2] ..... B65H 17/02

[52] U.S. Cl. ..... 242/67.3 R; 131/149

[58] Field of Search ..... 242/67.3 R, 67.1 R, 242/67.2, 56 R; 131/149; 83/150, 176, 516

[56] References Cited

U.S. PATENT DOCUMENTS

| | | | |
|---|---|---|---|
| 3,352,308 | 11/1967 | Lindgren | 131/149 X |
| 3,470,882 | 10/1969 | Clark | 131/149 X |
| 3,542,038 | 11/1970 | Hooper | 131/149 |
| 3,743,200 | 7/1973 | Hommerin | 242/67.3 R |
| 3,871,594 | 3/1975 | O'Neil | 242/56 R |
| 3,957,220 | 5/1976 | Beck | 242/67.3 R |

*Primary Examiner*—Edward J. McCarthy
*Attorney, Agent, or Firm*—John P. Snyder

[57] ABSTRACT

A device for winding a strip of material into a bobbin for storing tobacco leaf or portions thereof between the layers of the bobbin, the device comprising a spindle for holding a stock reel, a second, driven spindle for the bobbin and a suction box, along the suction surface of which the part of the strip of material located between the stock reel and the bobbin is passed, and a mechanism for applying the tobacco leaf portions to the strip of material above the suction surface, the device is characterized in that the suction surface is at an angle to the plane tangential to the bobbin and going through the line of intersection of the prolongation of the suction surface with the bobbin in order to provide a device in which deformation of the tobacco leaf due to drying by the suction box does not or only scarcely occurs.

11 Claims, 4 Drawing Figures

DEVICE FOR WINDING A BOBBIN

Figure 1:
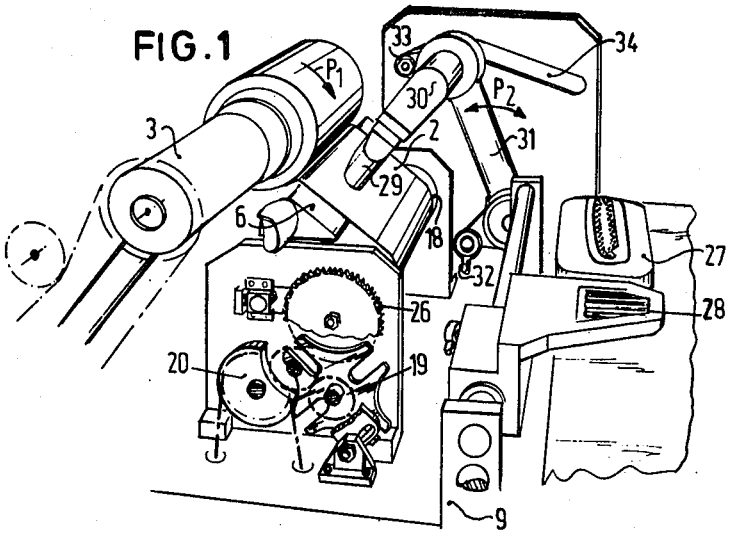

The invention relates to a device for winding a strip of material into a bobbin for storing tobacco leaf or portions thereof between the layers of the bobbin, the device comprising a spindle for holding a stock reel, a second, driven spindle for the bobbin and a suction box, along the suction surface of which the part of the strip of material located between the stock reel and the bobbin is passed, and a mechanism for applying the tobacco leaf portions to the strip of material above the suction surface.

The prior art devices of the kind set forth have the disadvantage that the tobacco leaf or portions thereof deposited on the path of material are subject to a first deformation by the drying effect of the air sucked in by the suction box before the portions of leaf are entrapped between the webs of the bobbin. Since such bobbins are also used for tobacco leaf portions already cut to size, for example, a wrapper for a cigar, it is important for the cut leaf portion not to change its shape during the storing process.

The invention has for its object to provide a device in which this deformation of the tobacco leaf does not or only scarcely occurs.

The device according to the invention is distinguished in that the suction surface is at an angle to the plane tangential to the bobbin and going through the line of intersection of the prolongation of the suction surface with the bobbin.

This disposition permits bringing each tobacco leaf portion so close to the bobbin that upon the subsequent winding of the web of material the leaf is directly entrapped between the webs of the bobbin and the time of sojourn of the leaf on the suction surface is at a minimum.

The deformation of the tobacco leaf portion in the webs of the bobbin is further counteracted by providing sufficient tension in the web of material during the winding operation so that owing to the tensile force in the web of material and to the consequent stress between the webs the tobacco leaf is clamped so that any deformation during a long storing time is avoided. According to the invention adequate stress in the device can be achieved by subjecting the second spindle constantly to a driving torque provided by the driving mechanism, whilst a periodically releasable braking mechanism engaging the web of material is arranged between the suction box and the stock reel. By the repetitive release of the braking mechanism the web of material is released and displaced only over a distance as required for clamping a tobacco leaf portion, after which the web is stopped and the driving torque maintains the required tensile force in the webs.

When the device is provided with a cutting bed normally employed in wrapping machines or the like, the applying mechanism is formed, in accordance with the invention, by a suction head cyclically movable between the cutting bed and the suction box. This cyclic movement is correlated with the periodical release of the braking mechanism so that when a wrapper or the like is severed, the suction head becomes operative, the severed leaf is deposited on the suction box, the braking mechanism is released and the severed leaf is directly entrapped between the webs of the bobbin.

Figure 2:
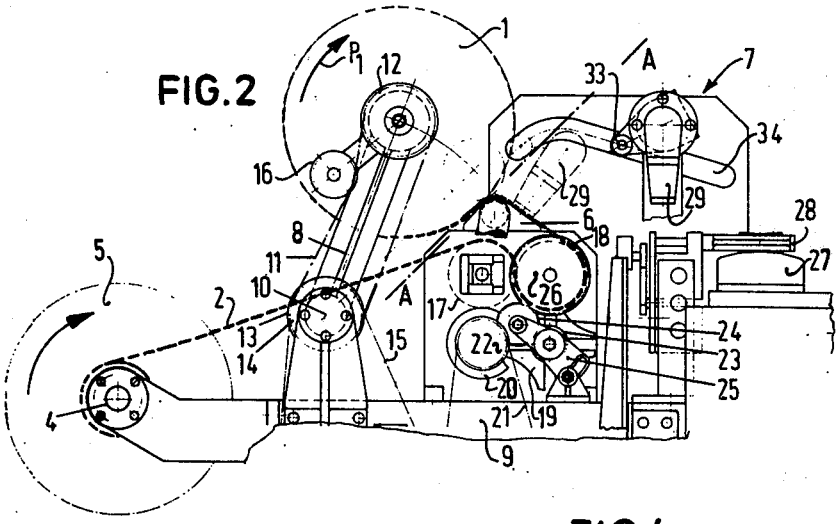
Figure 3:
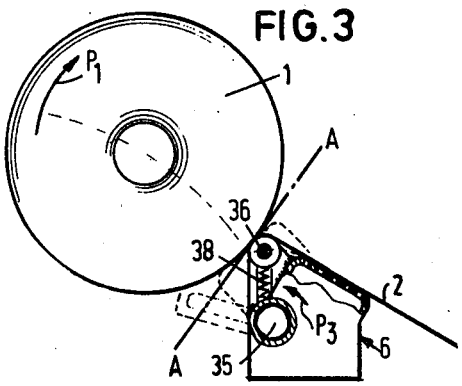
Figure 4:
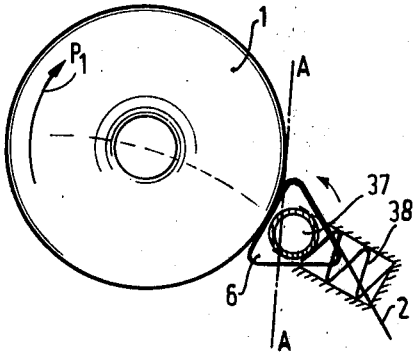

The invention will be described more fully with reference to three embodiments. In the drawing:

FIG. 1 is a perspective view of a winding device comprising a cutting bed with an applying mechanism constructed in the form of a cyclically movable suction head, FIG. 2 is a side elevation of the device of FIG. 1, FIG. 3 shows a different embodiment of the suction box illustrating the manner in which each time part of the patch of material is fed, FIG. 4, like FIG. 3, shows a third variant.

Referring to the Figures, reference numeral 1 designates the bobbin to be formed. This bobbin 1 is obtained by winding a web of material 2 around a driven spindle 3.

The web of material 2 is withdrawn from a stock reel 5 freely rotatable about a spindle 4 (see FIG. 2).

The portion of the web of material between the reel 5 and the bobbin 1 is passed along a suction box 6 disposed directly in front of the bobbin 1, whose suction surface has holes, whilst the suction box itself communicates with a source of subatmospheric pressure (not shown) so that ambient air is sucked across the web of material 2 via the holes in the suction surface of the suction box 6. This suction air ensures that tobacco leaf portions deposited by an applying mechanism generally designated by 7 are temporarily tacked by suction to the web of material 2.

According to the main feature of the invention the suction surface of the suction box 6 is directed to the bobbin 1 so that it is at an angle to the tangential plane indicated by the dot-and-dash line A-A in FIGS. 2, 3 and 4. This angle is sufficiently large for permitting the deposition of the tobacco leaf portions close to the bobbin 1 on the suction box 6. The spindle 3 of the bobbin 1 is journalled in a pivotable support 8, which surrounds a shaft 10 rigidly secured to the frame 9 of the device. It will be obvious that with an increase in circumference of the bobbin 1 the support 8 will deflect in anticlockwise direction away from the suction box 6 (see FIG. 2). The drive of the spindle 3 is implemented by an endless element 11, which is passed along a wheel 12 fastened to the spindle 3 and along a wheel 13 rotatable about the pivotal shaft 10. A wheel 14 driven by an endless element 15 is arranged coaxially with the wheel 13. Between the wheel 13 and the wheel 14 is arranged a slip coupling, whose slip limit is determined, for example, by the bias stress of a compression spring, which presses the slip plates of the coupling against one another. By means of a control-mechanism not further described, for example, with the aid of cams, the bias stress of the spring, that is to say, the slip limit of the slip coupling can be adjusted by the angular position of the support 8; this adjustment will be explained more fully hereinafter. The endless element 11 is stretched by a stretching wheel 16.

By a continuous drive by a driving motor arranged below in the frame 9 via the element 15, the wheel 14, the slip coupling, the wheel 13 and then the endless element 11, the wheel 12, the spindle 3 is constantly driven in the direction of the arrow P1.

In order to prevent a continuous run of the web of material 2 and hence in order to provide time for applying tobacco leaf portions, the web 2 is passed through a braking mechanism comprising a pair of rollers 17 and 18 disposed, in the embodiment shown, beneath the suction box 6. The braking mechanism 18 is periodically released so that the web is periodically or stepwise released to the bobbin 1. Owing to the constant action of the driving torque on the spindle 3 and to the effect of the braking mechanism between the rollers 17 and 18 a constant stress will prevail in the portion of the web behind the nip and in the layers of the bobbin 1.

The braking mechanism is each time released by a Maltese cross 19, which is each time stepped on through 90° by the associated wheel 20, which is turned through a chain 21 and a chain sprocket 22 driven by the motor in the frame below. In the embodiment shown the Maltese cross 19 will be each time displaced after a cycle of the applying mechanism 7, which will be explained more fully hereinafter.

The rotation of the Maltese cross 19 towards the right-hand roller 18 of the braking mechanism 17, 18 is performed through a transmission system comprising three pinions, of which the first pinion 23 is arranged on the shaft of the Maltese cross, the co-operating pinion 24 on a support 25 to be moved into a defined angular position and finally the pinion 26 co-operating with the pinion 24 is arranged on the rotary shaft of the roller 18. The transmission system between the Maltese cross 19 and the roller 18 permits of controlling the distance over which the web of material 2 is displaced stepwise, the angular turn of the Maltese cross 19 remaining the same, by an adaptation of the transmission ratio of the transmission system.

The embodiment shown in FIGS. 1 and 2 comprises an applying mechanism 7, which co-operates with a cutting bed 27 of a construction generally known in the tobacco industry. The cutting bed comprises an upright cutter in the form of the wrapper of a cigar to be severed, the cutter co-operating with a roller system 28 performing a translatory movement over and across the same so that after the deposition of the tobacco leaf on the bed 27 and the reciprocatory movement of the rollers 28 the wrapper to be made is severed. The associated feeding mechanism 7 comprises a suction head 29 of known type, which is cyclically movable between the cutting bed 27 and the suction box 6.

This cyclic movement is achieved by the connection of the suction head 29 with an arm 30, which is pivotally journalled around a pivotable support 31, which swings to and fro by means of a control rod 32 moved up and down in the direction of the arrow P2 by the main drive. The pivotable arm 30 is provided with a cam 33 rigidly secured thereto and being displaceable through a slot 34 in a cam guide. It will be obvious that by turning the support 31 the cam 33 will follow the path of the slot 34 so that the arm 30 performs such a translatory and rotary movement that the suction head 27 moves away from the cutting bed 27 and approaches the suction box 6 in normal direction and in the reverse direction. The mode of operation of the device shown in FIGS. 1 and 2 will be explained more fully hereinafter.

After a tobacco leaf is deposited on the cutting bed 27, the operator will produce a starting signal by depressing a control-button. A control-system not described in detail ensures an automatic performance of the following cycle for storing a severed wrapper. The cycle is initiated by the start of the roller mechanism 28 across the cutting bed 27 so that a wrapper is severed. Subsequently the suction head approaches the cutting bed 27 and by subatmospheric pressure the suction head sucks up the severed wrapper and carries it towards the suction box 6, for which purpose the control-rod 32 is energized. As soon as the suction head 29 approaches the suction box 6, the subatmospheric pressure in the suction head 29 is obviated and the wrapper is deposited on the portion of the web of material 2 located above the suction box 6. Thereupon the Maltese cross mechanism 19 is turned through 90° and the roller pair 17, 18 will perform a defined angular turn so that the web 2 is released over a defined distance. Owing to the constant drive by the element 15 on the wheel 14, the bobbin 1 will turn, as soon as the web 2 is released, as a result of the torque constantly exerted on the spindle 3 via the slip coupling between the wheels 13 and 14. The distance over which the web of material 2 is displaced is adjusted so that the severed tobacco leaf portion delivered by the suction head 29 is directly entrapped between the layers of the bobbin 1. In order to ensure constant tensile force in the web 2 the slip limit of the coupling can be adjusted so that at an increase in bobbin circumference the driving torque on the spindle 3 increases.

FIGS. 3 and 4 show two further embodiments in which the feed of a given part of the web of material 2 is performed in a different way. The suction box 6 of FIG. 3 is adapted to pivot about a shaft 35 so that after a given control-signal the suction box 6 engages the layers of the bobbin 1, the tobacco leaf lying therein being thus clamped tight. During this pivotal movement in the direction of the arrow P3 no relative displacement between the web 2 and the suction box 6 will take place, but during the reverse pivotal movement the web of material will stand still whereas the suction box 6 slides below the same. In order to compensate for the varying distance between the reversing edge 36 of the suction box and the pivotal shaft 35 the turning edge 36 is resiliently supported in the direction towards the pivotal shaft 35 at 38.

FIG. 4 shows a design similar to that of FIG. 3, but the suction box has a triangular cross-section. The suction box is adapted to rotate about a shaft 37, which is resiliently supported at 38 in order to allow the corners of the triangle to pass along the bobbin 1 at every turn of the suction box 6.

The invention is not limited to the embodiments depicted above. For example, there may be designed a device in which the bobbin is continuously wound up and a continuous strip of severed tobacco leaf is fed between the layers of the bobbin. The applying mechanism 7 co-operating herewith then has a matching shape.

What we claimed is:

1. A device for winding a web of material into a bobbin for storing tobacco leaf or portions thereof between the layers, said device comprising a spindle for holding a stock reel, a second, driven spindle for the bobbin and a suction box, along the suction surface of which the portion of the web of material located between the stock reel and the bobbin is passed, and a mechanism for applying the tobacco portions to the web of material above the suction surface, characterized in that the suction surface is at an angle to the plane tangential to the bobbin and going through the line of intersection of the prolongation of said suction surface with the bobbin.

2. A device as claimed in claim 1 characterized in that the second spindle is constantly exposed to a torque by a driving mechanism and in that a periodically releasable braking mechanism engaging the web of material is arranged between the suction box and the stock reel.

3. A device as claimed in claim 2 characterized in that the braking mechanism comprises a pair of clamping rollers, through the nip of which is passed the web of material.

4. A device as claimed in claim 2 characterized in that the releasing mechanism of the braking rollers is formed by a Maltese cross driving one of the rollers.

5. A device as claimed in claim 1 characterized in that the second spindle is journalled in a pivotable support, at the pivotal shaft of which is arranged an adjustable slip coupling, the setting force of the coupling being a function of the angular position of the support.

6. A device as claimed in claim 1 comprising a cutting bed for cutting up a tobacco leaf into portions, characterized in that the applying mechanism is formed by a cyclically movable suction head between the cutting bed and the suction box.

7. A device as claimed in claim 6 characterized in that the cyclic movement of the suction head controls the release of the braking mechanism.

8. A device for winding a web of material into a bobbin for storing tobacco leaves between the layers of the bobbin, said device comprising a supply spindle for holding a stock reel, a driven spindle spaced from said supply reel and means for guiding said web to pass from the supply spindle onto said driven spindle, said means including a suction box adjacent said bobbin in underlying relation to said web to define a nip between the suction box and the bobbin and a guide member spaced outwardly from said nip whereby a surface portion of said web between said guide member and said nip lies in a plane which defines a large included angle with a plane tangent to said bobbin and passing through said nip, and means for applying tobacco leaf portions onto said surface portion closely adjacent said nip whereby said tobacco leaf portions are minimally subjected to the drying action of said suction box.

9. A device as defined in claim 8 wherein means is provided for alternately braking and releasing said guide member whereby said web winds onto said bobbin in step-by-step fashion.

10. A device as defined in claim 8 wherein said large included angle is at least in the order of 90°.

11. A device as defined in claim 10 wherein said suction box includes a flat suction surface.

* * * * *